US007770290B2

(12) United States Patent
Nakamae

(10) Patent No.: US 7,770,290 B2
(45) Date of Patent: Aug. 10, 2010

(54) ELECTRICAL CONNECTION METHOD FOR PLURAL COAXIAL WIRES

(75) Inventor: Kazuo Nakamae, Yokohama (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 239 days.

(21) Appl. No.: 12/078,187

(22) Filed: Mar. 27, 2008

(65) Prior Publication Data

US 2008/0235945 A1 Oct. 2, 2008

(30) Foreign Application Priority Data

Mar. 27, 2007 (JP) ..... P2007-082672

(51) Int. Cl.
*H01R 43/00* (2006.01)

(52) U.S. Cl. ..... 29/857; 29/828; 29/858; 29/859; 29/860; 29/868

(58) Field of Classification Search ..... 29/828, 29/857, 858, 859, 860, 868
See application file for complete search history.

(56) References Cited

U.S. PATENT DOCUMENTS 5,281,762 A * 1/1994 Long et al. ..... 174/78
6,031,185 A * 2/2000 Bouveret et al. ..... 174/84 R
6,273,753 B1 * 8/2001 Ko ..... 439/579
6,305,978 B1 * 10/2001 Ko et al. ..... 439/579
6,705,896 B1 * 3/2004 Chang et al. ..... 439/607.44
7,628,647 B2 * 12/2009 Semba et al. ..... 439/579

FOREIGN PATENT DOCUMENTS

JP 2001-307556 A 11/2001
JP 2005-328696 A 11/2005

* cited by examiner

*Primary Examiner*—C. J Arbes
(74) *Attorney, Agent, or Firm*—Venable LLP; Michael A. Sartori; Steven J. Schwarz

(57) ABSTRACT

The present invention relates to a method of properly connecting respective shields in a plurality of extra fine coaxial wires via a common conductive member. The plurality of coaxial wires having the shields that are partially exposed is arranged in parallel. A metal adhesive material is placed on the respective shields in the coaxial wires and is melted by being irradiated with laser light. Then, the respective shields are connected electrically via the common conductive member when the common conductive member is placed on the melted metal adhesive material.

9 Claims, 6 Drawing Sheets

ELECTRICAL CONNECTION METHOD FOR PLURAL COAXIAL WIRES

BACKGROUND OF THE INVENTION

1. Field of the Invention

The present invention relates to a method of electrically connecting shields that are contained in a plurality of extra fine coaxial wires respectively, with a common conductive member.

2. Related Background Art

The extra fine coaxial wire includes a center conductor extending along a predetermined axis, an inner insulator provided on the outer periphery of the center conductor, a shield provided on the outer periphery of the inner insulator, and an insulating jacket provided on the outer periphery of the shield. The center conductor and the shield are comprised of conductive metals, for example a tin-plated copper alloy, respectively. The inner insulator and the insulating jacket are comprised of an insulating resin, for example PFA and PET, respectively. Then, the outer diameter of the insulating jacket is about 0.25 mm to 0.5 mm. Since such an extra fine coaxial wire has a very slim outer diameter, it is suitable for use when connecting electronic components electrically in a small electronic apparatus.

When connecting the shields in the plurality of extra fine coaxial wires electrically, first, in a portion in the longitudinal direction of the extra fine coaxial wire, a part of the insulating jacket is removed by, for example, irradiating with laser light. As a result, the shield is exposed. Further, parts of the shield and the inner insulator are removed, and thereby the center conductor is exposed. At this time, the exposed shield is expanded. As a result, it is likely to cause a connection failure among the shields in the plurality of extra fine coaxial wires. For example, Japanese Patent Application Laid-open No. 2005-328696 (Document 1) and Japanese Patent Application Laid-open No. 2001-307556 (Document 2) disclose the technologies that are intended for solving such a problem.

The technology disclosed in Document 1, first, in each of the plurality of extra fine coaxial wires, a part of the insulating jacket is removed and thereby the exposed shield is covered by a solder layer; the solder layer and the shield are cut off at a predetermined position of the solder layer; and the solder layer and the shield from the cut position to the top end are removed together. Then, the conductive member common to these plurality of extra fine coaxial wires is fixed onto the respective solder layers of the plurality of extra fine coaxial wires that are not removed and remain, and thereby, the electrical connection among the plurality of extra fine coaxial wires is made. On the other hand, Document 2 discloses the technology by which the respective shields in the plurality of extra fine coaxial wires that are exposed by removing a part of the insulating jacket and a ground bar (a conductive member common to the plurality of extra fine coaxial wires) are soldered to form a connection, thereby integrating the plurality of extra fine coaxial wires. Also, the technologies disclosed in both of Documents 1 and 2 are intended to connect electrically via the conductive member common to the respective shields of the extra fine coaxial wires by soldering and thereby prevent the shields from expanding during the connecting work.

SUMMARY OF THE INVENTION

The present inventors have examined the above prior art, and as a result, have discovered the following problems. That is, Namely, when connecting the respective shields of the plurality of extra fine coaxial wires electrically via the common conductive member, the technologies by soldering described in Documents 1 and 2 have to melt the solder by the use of a solder iron. At this time, the solder expands, and then the shield connection portion hardens and loses flexibility.

The present invention has been developed to eliminate the problems described above. It is an object of the present invention to provide an electrical connection method among plural coaxial wires which is capable of properly connecting the respective shields of the plurality of extra fine coaxial wires via the common conductive member.

The present invention relates to the electrical connection method among the plural coaxial wires, for properly connecting the respective shields of the plural coaxial wires via the common conductive member, and each of these plural coaxial wires includes the center conductor, the inner insulator provided on the outer periphery of the center conductor, the shield provided on the outer periphery of the inner insulator, and the insulating jacket provided on the outer periphery of the shield. Further, the plural coaxial wires may have an individually independent insulator jacket or the common insulating jacket as an insulating jacket for each coaxial wire. In case of a tape-like cable in which these plural coaxial wires are integrated by the common insulating jacket, since previously parallel-arranged conditions are maintained in the respective coaxial wires, the coaxial wires are processed and handled easily. Namely, it eliminates the need for a parallel arrangement itself for the coaxial wires, and also, it is possible to expose the respective shields simultaneously. Further, in accordance with the present invention, the connection method can be applied to a case preferably when connecting electrically between or among the shields in some coaxial wires (at least two or more coaxial wires) among the plural coaxial wires contained in the tape-like cable.

The plural coaxial wires are arranged in parallel so that longitudinal directions thereof are respectively matched while being integrated individually or with a common insulating jacket that functions as an insulating jacket of each coaxial wire. In the plural coaxial wires that are arranged in parallel in this manner, parts of the insulating jackets are removed along a predetermined direction crossing their individual directions. Because of the removal of the jackets, the respective shields in these plural coaxial wires are exposed. Further, in the case of the tape-like cable in which the plural coaxial wires are integrated with the common insulating jacket, the need to arrange the coaxial wires in parallel is eliminated.

The connection method according to the present invention has a first embodiment and a second embodiment; the first embodiment is to heat, melt, and adhere a metal adhesive material to the respective shields in the plural coaxial wires that are previously parallel-arranged prior to connecting the common conductive member; and the second embodiment is to previously heat and melt the metal adhesive material on the common conductive member and thereafter connect the respective exposed portions of the shields in the plural coaxial wires to the common conductive member.

In both of the embodiments, the metal adhesive material and the common conductive member have shapes that the respective exposed portions of the shields extend along the predetermined direction (the direction crossing individual longitudinal directions of the plural coaxial wires that are parallel-arranged) and therewith have at least a length capable of connecting between the shields in the coaxial wires adjacent to each other. Also, the metal adhesive material is comprised of a low melting point metal.

The low melting point metal means a metal that has a melting point lower than that of silicon. Also, it is preferable that the metal adhesive material to be melted has a plate shape that has mutually opposing planes, or a rod shape, in consideration of easiness of installation to the respective shields in the plural coaxial wires.

In the connection method according to the first embodiment, the metal adhesive material is placed on the exposed portions of the shields in the plural coaxial wires that are to be connected, and the metal adhesive material is heated and melted by being irradiated with laser light. Further, the common conductive member is placed on the exposed portions of the shields in the plural coaxial wires, via the metal adhesive material that is melted by being irradiated with laser light. Thus, the exposed portions of the shields in the plural coaxial wires are connected to one another electrically, via the common conductive member.

On the other hand, in the connection method according to the second embodiment, the metal adhesive material is placed on the common conductive member that has been prepared prior to arranging the coaxial wires, and in this condition the metal adhesive material is heated and melted by being irradiated with laser light. Further, the respective exposed portions of the shields in the plural coaxial wires that are arranged in parallel are placed on the common conductive member via the metal adhesive material melted by being irradiated with laser light. Thus, the exposed portions of the shields in the plural coaxial wires are connected to one another electrically, via the common conductive member.

In both of the embodiments 1 and 2 described above, it is preferable to cut remaining portions that exclude portions in contact with the melted metal adhesive material, from the respective exposed portions of the shields in the plural coaxial wires. The purpose thereof is to avoid contingencies, when the center conductors in these plural coaxial wires are welded to micro-fabricated circuit substrate, etc., such as directly bringing the center conductors into contact with the circuit wiring.

It is preferable to delete unnecessary portions of such exposed portions of the shields after the exposed portions of the shields in the plural coaxial wires have been connected electrically via the common conductive member. Also, any unnecessary portions may be deleted after the metal adhesive material melted by being irradiated with laser light has adhered to the respective exposed portions of the shields in the plural coaxial wires.

In the connection methods according to the present invention, it is preferable to heat at least one of the shields and the common conductive member by irradiating with laser light prior to irradiating the metal adhesive material with laser light. The reason is that workability to the connection will be considerably improved.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will be apparent to those skilled in the art from this detailed description.

DESCRIPTION OF THE PREFERRED EMBODIMENTS

Figure 1:
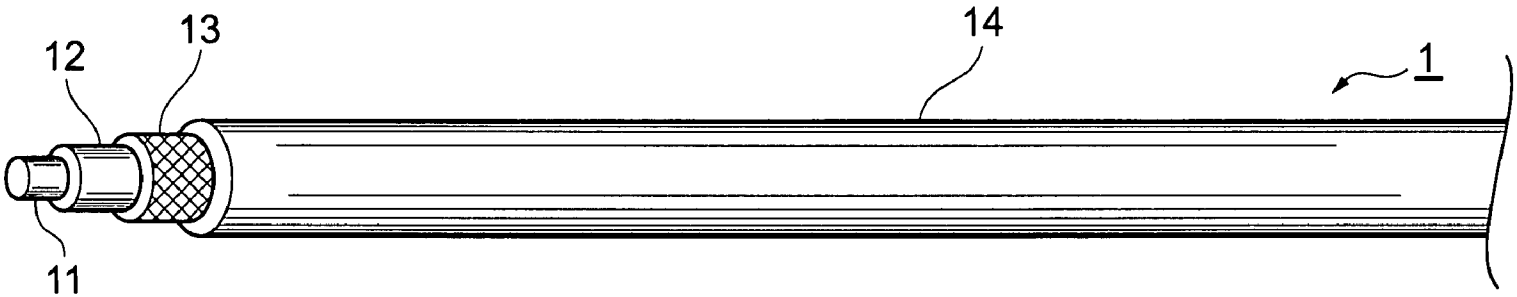
FIG. 1 is a perspective view showing an extra fine coaxial wire of which tip end is processed.

In the following, embodiments of an electrical connection method among plural coaxial wires according to the present invention will be explained in detail with reference to FIGS. 1 to 3 and 4A to 6D. In the description of the drawings, identical or corresponding components are designated by the same reference numerals, and overlapping description is omitted.

Figure 2:
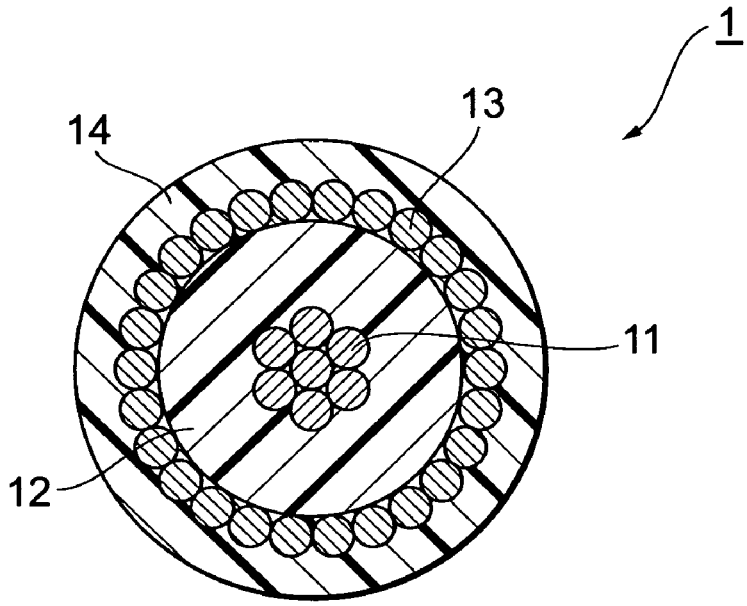
FIG. 2 is a view showing a cross-sectional structure of the extra fine coaxial wire shown in FIG. 1.

FIG. 1 is a perspective view showing an extra fine coaxial wire for which its tip end has been processed, and FIG. 2 is a view showing a cross-sectional structure of the extra fine coaxial wire shown in FIG. 2. As shown in FIGS. 1 and 2, the extra fine coaxial wire 1 includes a center conductor 11 extending along a predetermined axis, an inner insulator 12 provided on the outer periphery of the center conductor 11, a shield 13 provided on the outer periphery of the inner insulator 12, and an insulating jacket 14 provided on the outer periphery of the shield 13. The center conductor 11 and the shield 13 are comprised of conductive metals, for example a tin-plated copper alloy, respectively. The inner insulator 12 and the insulating jacket 14 are comprised of an insulating resin, such as PFA and PET, respectively. Then, the outer diameter of the insulating jacket 14 is about 0.25 mm to 0.5 mm. Thus, the extra fine coaxial wire 1 has a very slim outer diameter. In the extra fine coaxial wire 1 shown in FIG. 1, the insulating jacket 14 is removed by, for example, being irradiated with laser light, and then a part of the shield 13 is exposed in a certain definite range in the longitudinal direction including one of its ends. Further, the center conductor 11 is exposed by parts of the shield 13 and the inner insulator 12 being removed.

Figure 3:
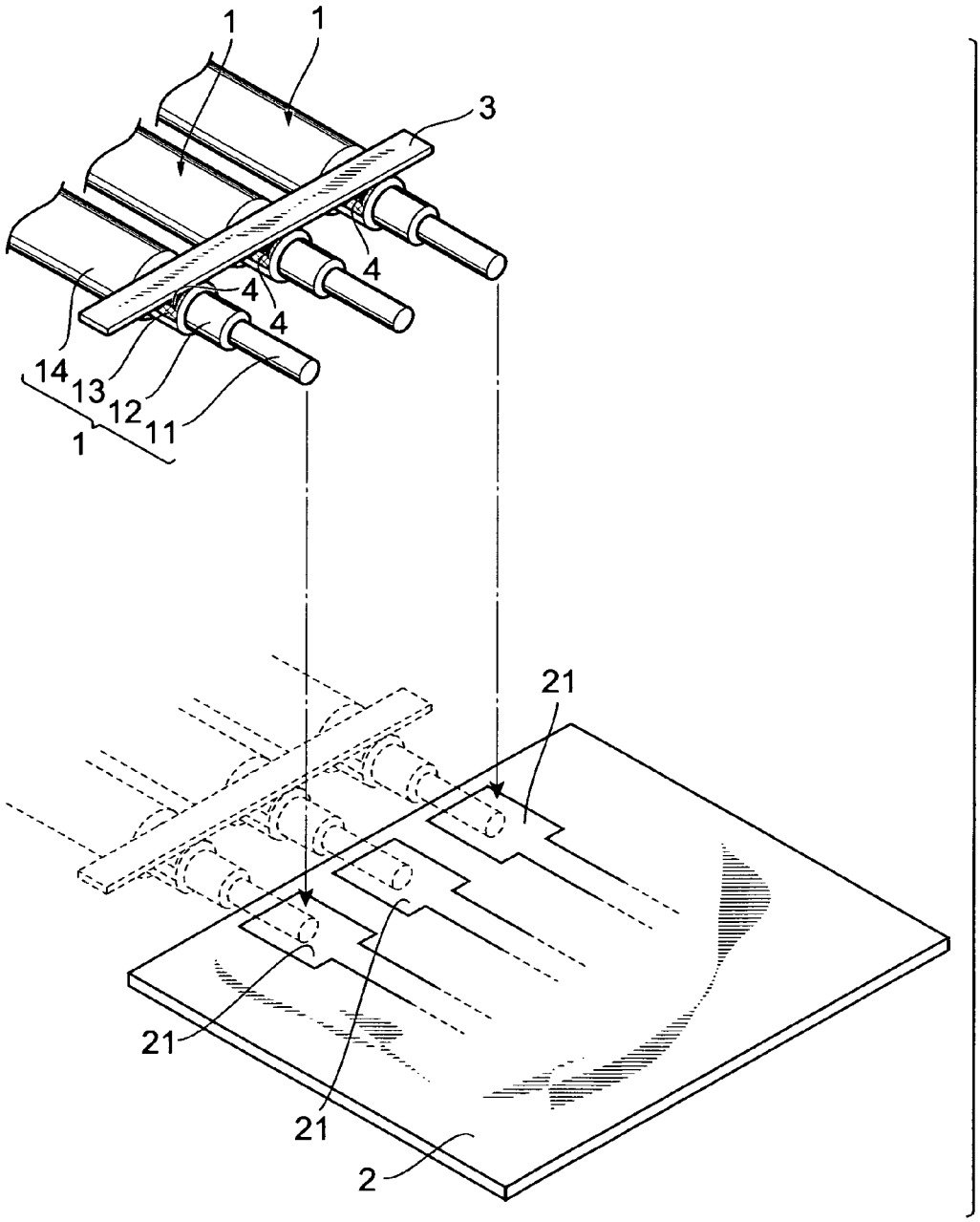
FIG. 3 is a view showing a state where a plurality of the extra fine coaxial wires in which the shields are connected to one another electrically via a common conductive material is connected to a circuit substrate.

FIG. 3 is a view showing a state where the plurality of extra fine coaxial wires 1, in which the respective shields 13 are connected to one another electrically via a common conductive member, is connected to a circuit substrate. In FIG. 3, the respective center conductors 11 of the three extra fine coaxial wires 1, which have respective ends aligned and are arranged in parallel, are connected to the terminals 21 of a substrate 2 by soldering. The substrate 2 is, for example, a flexible printed substrate.

In the three extra fine coaxial wires 1 in which the respective center conductors 11 are connected to the connecting terminals 21 of the substrate 2, the respective shields 13 are connected to one another electrically via the common conductive member 3. Further, in FIG. 3, the extra fine coaxial wires 1 include the individual insulating jackets 14 and are arranged so that the respective longitudinal directions are aligned. However, these extra fine coaxial wires 1 may constitute a tape-like cable that is covered integrally with the common insulating jacket. Moreover, only some extra fine coaxial wires (at least two or more extra fine coaxial wires) that are contained in the tape-like cable may be connected to one another electrically via the common conductive member 3.

The common conductive member 3 is a metal component for equalizing the potentials (generally, the ground potential) of the respective shields 13 in the three extra fine coaxial wires 1. The connection method among the plural coaxial wires according to the present invention connects the shields 13 in the extra fine coaxial wires 1 to one another electrically, via the common conductive member 3.

First Embodiment

Each connecting process in the first embodiment of the electrical connection method among the plural coaxial wires according to the present invention will be sequentially described hereinafter. FIGS. 4A to 4D are process charts for showing the first embodiment of the electrical connection method among the plural coaxial wires according to the present invention.

Figure 4A:
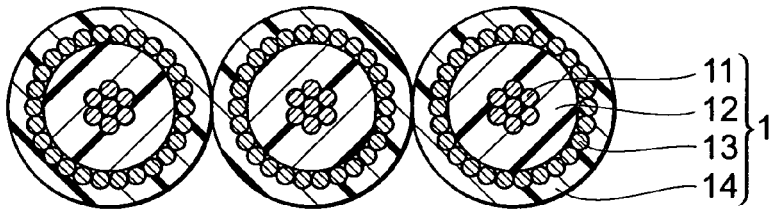
FIGS. 4A to 4D are process charts for showing a first embodiment of an electrical connection method among the plural coaxial wires according to the present invention.

In the connection method according to the first embodiment, as shown in FIG. 4A, first, three extra fine coaxial wires 1 in which shields 13 are exposed in parts of the respective longitudinal directions thereof are parallel-arranged.

Figure 4B:
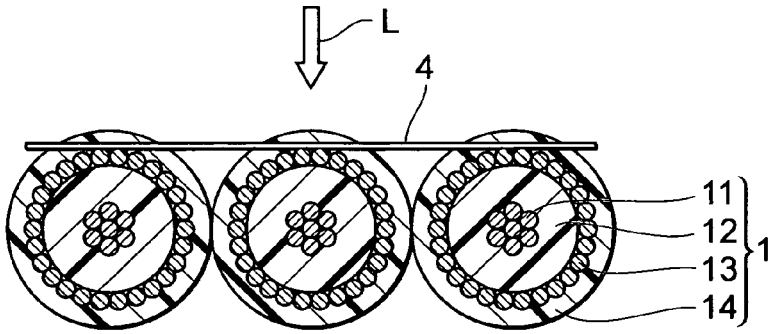

Subsequently, as shown FIG. 4B, a metal adhesive material 4 of rectangular shape is placed on the respective shields 13 of the three extra fine coaxial wires 1, and a metal adhesive material 4 is irradiated with laser light L. Thus, the metal adhesive material 4 is heated by being irradiated with laser light, and therefore, the metal adhesive material 4 is melted.

Figure 5A:
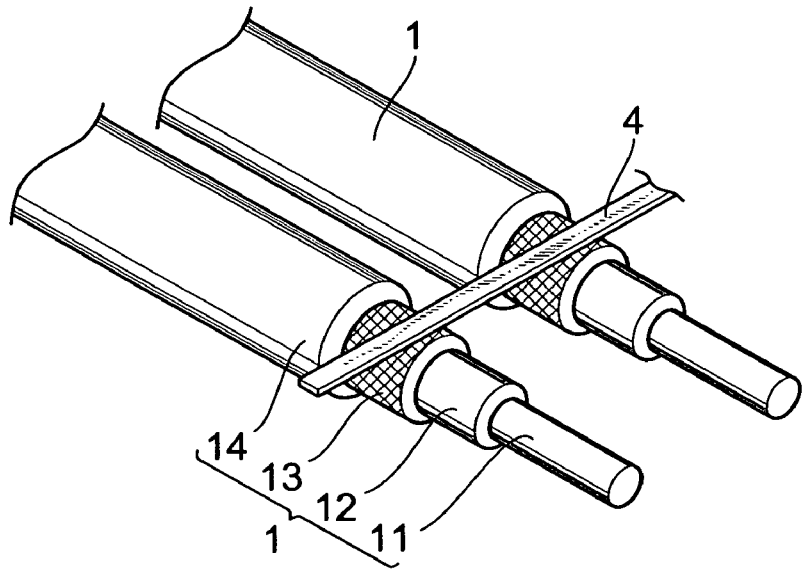
FIGS. 5A and 5B are perspective views showing one example of shapes of a metal adhesive material.
Figure 5B:
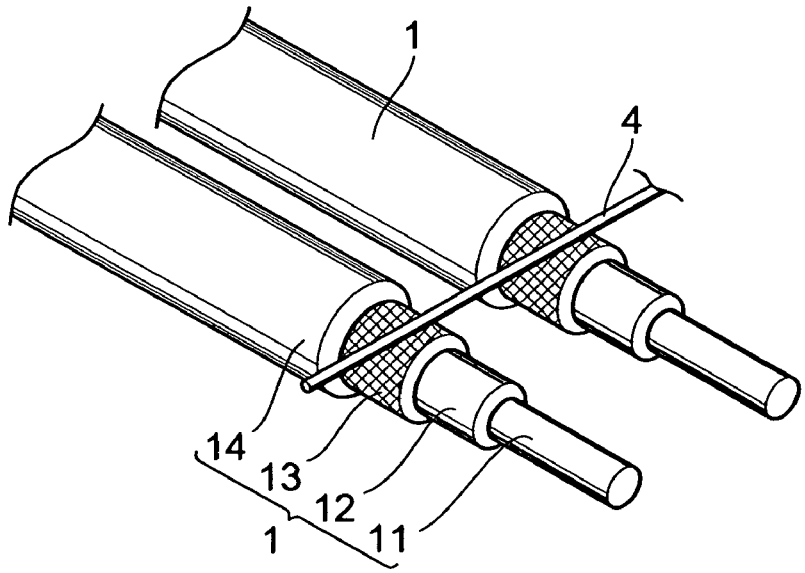

The metal adhesive material 4 may take various shapes. FIGS. 5A and 5B are perspective views showing one example of shapes of the metal adhesive material. The metal adhesive material 4 may, as shown in FIG. 5A, have a rectangular shape that has a length capable of simultaneously contacting the shields 13 in the extra fine coaxial wires 1 that are to be connected and has surfaces that face each other. Also, as shown in FIG. 5B, the metal adhesive material 4 may have a rod shape having a length capable of simultaneously contacting the shields 13 in the extra fine coaxial wires 1 that are to be connected.

Figure 4C:
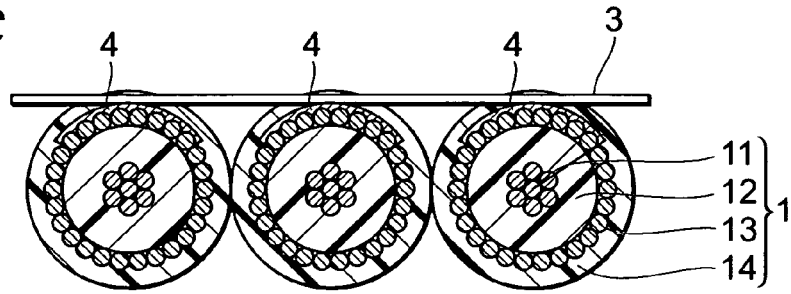

Then, as shown in FIG. 4C, the common conductive member 3 is placed on the shields 13 (exposed portions) in the extra fine coaxial wires 1 via the metal adhesive material 4 that has been melted. Thus, the respective shields 13 in the three extra fine coaxial wires 1 are connected to one another electrically, via the common conductive member 3. The shields 13 and the common conductive member 3 are connected to each other, enabling proper electrical-connection of the shields 13 in the extra fine coaxial wires 1 that are arranged in parallel without losing flexibility in the place where the shields 13 and the common conductive member 3 are connected. When the shields 13 or the common conductive member 3 are heated by being irradiated with laser light prior to heating of the metal adhesive material 4, work efficiency is improved and the connection is proper. Thus, it is preferable to irradiate with laser light prior to heating the metal adhesive material 4.

Figure 4D:
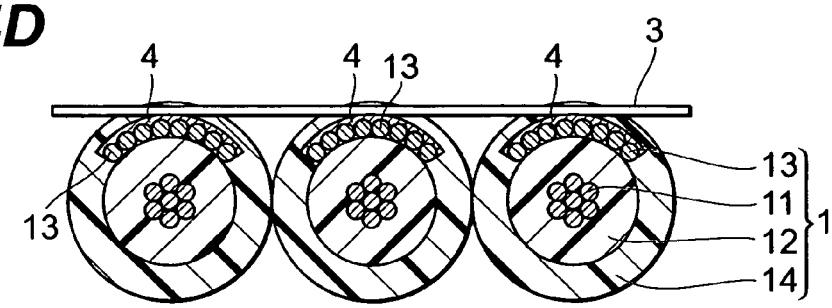

When the electrical connection between the shields 13 and the common conductive member 3 is completed, the remaining portions, excluding at least the portions in contact with the melted metal adhesive material 4 from the exposed portions of the shields 13, are cut off, as shown in FIG. 4D. The purpose thereof is to avoid contingencies, when the center conductors in the extra fine coaxial wires 1 are welded to the substrate 2, etc., such as directly bringing unnecessary exposed portions of the shields 13 into contact with the circuit wiring. It is preferable to delete unnecessary portions of such exposed portions of the shields 13 after the exposed portions of the shields 13 in the extra fine coaxial wires 1 have been connected electrically, via the common conductive member 3. Also, the unnecessary portions may be deleted after the metal adhesive material 4 melted by being irradiated with laser light has adhered to the respective exposed portions of the shields 13 in the extra fine coaxial wires 1.

Second Embodiment

Next, each connecting step in the second embodiment of the electrical connection method among the plural coaxial wires according to the present invention will be sequentially described hereinafter. FIGS. 6A to 6D are process charts for showing the second embodiment of the electrical connection method among the plural coaxial wires according to the present invention.

Figure 6A:
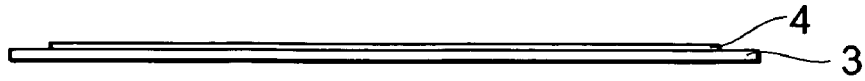
FIGS. 6A to 6D are process charts for showing a second embodiment of the electrical connection method among the plural coaxial wires.

In the connection method according to the second embodiment, as shown in FIG. 6A, a common conductive member 3 of rectangular shape capable of simultaneously contacting with the shields 13 in the three extra fine coaxial wires 1 that are to be connected is first prepared.

Figure 6B:
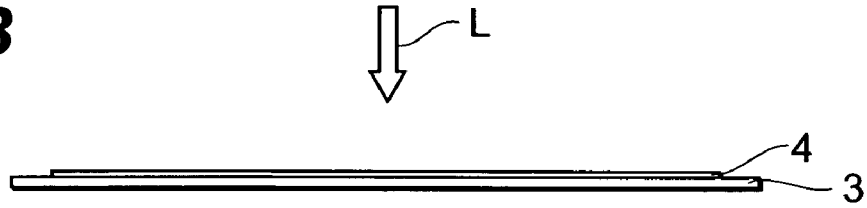

Subsequently, as shown FIG. 6B, the metal adhesive material 4 (the shape may be equivalent to that shown in FIGS. 5A and 5B) is placed on the common conductive member 3 and the metal adhesive material 4 is irradiated with laser light L. Thus, the metal adhesive material 4 is heated and then is melted.

Figure 6C:
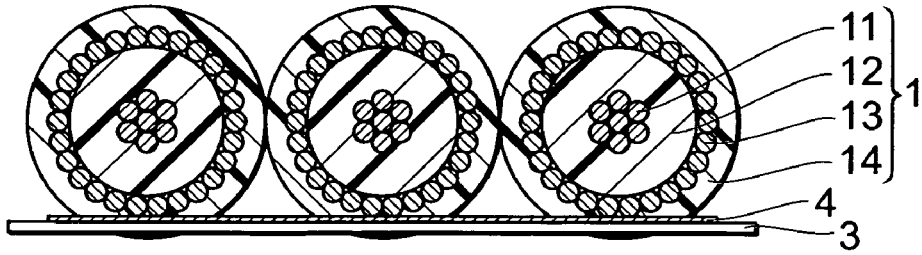

Then, as shown in FIG. 6C, the shields 13 (the exposed portions) in the three extra fine coaxial wires 1 are placed on the common conductive member 3 via the melted metal adhesive material 4. In this way, the respective shields 13 in the three extra fine coaxial wires 1 are connected to one another electrically, via the common conductive member 3. The shields 13 and the common conductive member 3 are connected to one another, enabling proper electrical-connection of the shields 13 in the extra fine coaxial wires 1 that are arranged in parallel without losing flexibility in the place where the shields 13 and the common conductive member 3 are connected. When the shields 13 or the common conductive member 3 are heated by being irradiated with laser light prior to heating of the metal adhesive material 4, work efficiency is improved and the connection is proper. Thus, it is preferable to irradiate with laser light prior to heating the metal adhesive material 4.

Figure 6D:
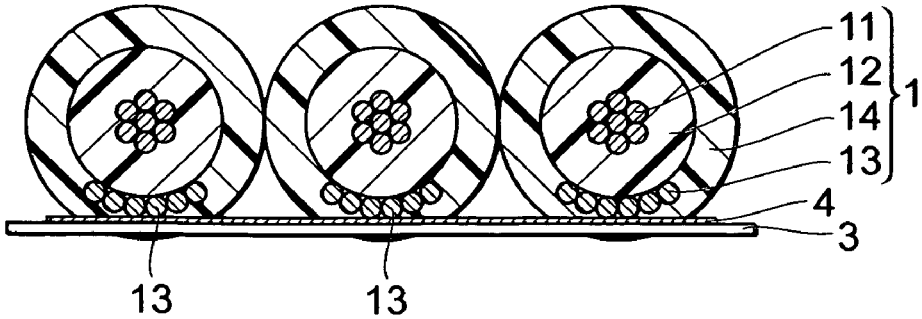

When the electrical connection between the shields 13 and the common conductive member 3 is completed, the remaining portions, excluding at least the portions in contact with the melted metal adhesive material 4 from the exposed portions of the shields 13, are cut off, as shown in FIG. 6D. The purpose thereof is to avoid contingencies, when the center conductors in the extra fine coaxial wires 1 are welded to the substrate 2, etc., such as directly bringing the unnecessary exposed portions of the shields 13 into contact with the circuit wiring. It is preferable to delete unnecessary portions of such exposed portions of the shields 13 after the exposed portions of the shields 13 in the extra fine coaxial wires 1 have been connected electrically via the common conductive member 3. Also, the unnecessary portions may be deleted after the metal adhesive material 4 that is melted by being irradiated with laser light has adhered to the respective exposed portions of the shields 13 in the extra fine coaxial wires 1.

Moreover, even in both of embodiments 1 and 2 described above, the common conductive member 3 is the conductive portion of the flexible printed circuit substrate or the ground bar. It is preferable for the metal adhesive material 4 to contain a metallic foil and have a thin sheet shape having a thickness of 1 μm to 1 mm or a rod shape having a diameter of about 1 mm. The rectangular shape of the metal adhesive material 4 contains a plate shape of the metal adhesive material having a width of 0.2 mm to 1 mm. Further, the metal adhesive material 4 is comprised of a metal that has conductivity and a low melting point, such as tin, indium, gold, silver, and copper, and then alloys of Sn—Cu, Sn—Ag, Sn—Ag—Cu, Sn—Ag—Bi, etc. It is preferable for the Laser light L to have an excellent light-condensing property, and a beam diameter of 20 μm or less. For the laser light source, a fiber laser light source and a YAG laser light source are preferred and if light-condensing property is improved, a semiconductor laser light source can also be used.

Further description of the metal adhesive material 4 is the following. Namely, the melting point of tin is 505.08 K, and the melting point of indium is 429.75 K. Since tin and indium have low meting points and are easily soluble, they are preferable for use for the metal as adhesive material 4. Also, tin is the same material as that which is plated on the respective surfaces of the center conductor 11 in the extra fine coaxial wires 1 and the shields 13. Thus, the metal adhesive material 4 comprised of tin tends to conform to the center conductor 11 or the shields 11. Indium also produces an alloy with tin relatively easily and therefore easily adheres when melting. In addition, Au is similar for producing an alloy.

The present invention is not limited to the embodiment described above and is capable of various modifications. For instance, in the embodiments described above, the metal adhesive material 4 is placed on the shields 13; the laser light L is irradiated on the metal adhesive material 4; the metal adhesive material 4 is heated and melted; the common conductive member 3 is placed on the metal adhesive material 4; and thereby the shields 13 and the common conductive member 3 are connected each other. However, in reverse, the metal adhesive material 4 is placed on the common conductive member 3; the laser light L is irradiated on the metal adhesive material 4; the metal adhesive material 4 is heated and melted; the shields 13 are placed on the melted metal adhesive material 4; and the shields 13 and the common conductive member 3 are connected to each other.

As described above, the present invention can easily connect the shields (the exposed portions) in the plurality of extra fine coaxial wires via the common conductive member. Also, the connection condition can be maintained properly.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A method of electrically connecting plural coaxial wires, comprising the steps of:

preparing plural coaxial wires each having a center conductor, an inner insulator provided on an outer periphery of said center conductor, a shield provided on an outer periphery of said inner insulator, and an insulator jacket provided on an outer periphery of said shield, said plural coaxial wires being arranged in parallel so that longitudinal directions thereof are respectively matched while being integrated individually or with a common insulating jacket that functions as an insulating jacket of each coaxial wire;

exposing parts of said shield in said plural coaxial wires by removing parts of said insulating jackets thereof along a predetermined direction crossing said plural coaxial wires that are arranged in parallel;

placing a metal adhesive material having a shape extending along the predetermined direction and comprised of a low melting point metal on exposed portions of said shields in said plural coaxial wires along the predetermined direction;

melting said metal adhesive material by irradiating said metal adhesive material with laser light; and electrically connecting exposed portions of said shields in said plural coaxial wires via a common conductive member by placing said common conductive member having at least a length capable of connecting between shields in the coaxial wires adjacent to each other via said metal adhesive material that is melted by being irradiated with the laser light on the exposed portions of said shields in said plural coaxial wires.

2. A method according to claim 1, wherein said metal adhesive material has a plate shape with flat surfaces facing each other or a rod shape.

3. A method according to claim 1, wherein, after the exposed portions of said shields in said plural coaxial wires are connected electrically via said common conductive member, remaining portions of said shields, excluding at least portions in contact with said melted metal adhesive material from the exposed portions of said shields in said plural coaxial wires, are cut off.

4. A method according to claim 1, wherein, after said metal adhesive material melted by being irradiated with the laser light adheres to the exposed portions of said shields in said plural coaxial wires, remaining portions of said shields, excluding at least portions in contact with said melted metal adhesive material from the exposed portions of said shields in said plural coaxial wires, are cut off.

5. A method according to claim 1, wherein, prior to irradiating said metal adhesive material with the laser light, at least one of said shields and said common conductive member is heated by being irradiated with the laser light.

6. A method of electrically connecting plural coaxial wires, comprising the steps of:

preparing plural coaxial wires each having a center conductor, an inner insulator provided on an outer periphery of said center conductor, a shield provided on an outer periphery of said inner insulator, and an insulator jacket provided on an outer periphery of said shield, said plural coaxial wires being arranged in parallel so that longitudinal directions thereof are respectively matched while being integrated individually or with a common insulating jacket that functions as an insulating jacket of each coaxial wire;

exposing parts of said shield in said plural coaxial wires by removing parts of said insulating jackets thereof along a predetermined direction crossing said plural coaxial wires that are arranged in parallel;

preparing a common conductive member having at least a length capable of connecting between the shields in the coaxial wires adjacent to each other;

placing a metal adhesive material having a shape extending along the predetermined direction and comprised of a low melting point metal along the predetermined direction on said common conductive member;

melting said metal adhesive material by irradiating said metal adhesive material with laser light; and electrically connecting the exposed portions of said shields in said plural coaxial wires via said common conductive member by placing the exposed portions of said shields in said plural coaxial wires that are arranged in a line along the predetermined direction on said common conductive member via said metal adhesive material melted by being irradiated with the laser light.

7. A method according to claim 6, wherein said metal adhesive material has a plate shape with flat surfaces facing each other or a rod shape.

8. A method according to claim 6, wherein, after the exposed portions of said shields in said plural coaxial wires are connected electrically via said common conductive member, remaining portions of said shields, excluding at least portions in contact with said melted metal adhesive material from the exposed portions of said shields in said plural coaxial wires, are cut off.

9. A method according to claim 6, wherein, prior to irradiating said metal adhesive material with the laser light, at least one of said shields and said common conductive member is heated by being irradiated with the laser light.

* * * * *